US006138574A

United States Patent [19]

Zaguroli, Jr.

[11] Patent Number: 6,138,574

[45] Date of Patent: Oct. 31, 2000

[54] OVERHEAD TROLLEY—RAIL SYSTEM FOR CONVEYORS

[75] Inventor: James Zaguroli, Jr., Drayton Plains, Mich.

[73] Assignee: Knigh Industries, Inc., Auburn Hills, Mich.

[21] Appl. No.: 09/105,310

[22] Filed: Jun. 26, 1998

[51] Int. Cl.[7] ..... E01B 5/02

[52] U.S. Cl. ..... 104/106; 104/89; 104/93; 104/108; 104/118; 105/155; 105/148; 105/150

[58] Field of Search ..... 104/89, 93, 95, 104/106, 108, 172.4, 172.3, 118; 105/154, 146, 148, 150; 285/370, 197

[56] References Cited

U.S. PATENT DOCUMENTS

| | | | |
|---|---|---|---|
| 4,464,996 | 8/1984 | Veith | 104/172 |
| 4,645,182 | 2/1987 | Stoll | 254/264 |
| 4,694,531 | 9/1987 | Foy | 16/87.4 |
| 5,231,932 | 8/1993 | Enderlein et al. | 104/162 |
| 5,443,151 | 8/1995 | Taylor | 198/860.1 |
| 5,769,460 | 6/1998 | Imai | 285/18 |

*Primary Examiner*—S. Joseph Morano
*Assistant Examiner*—Frantz Jules
*Attorney, Agent, or Firm*—John R. Benefiel

[57] ABSTRACT

An overhead trolley track system has extruded aluminum track sections having tubular portions, adjacent track sections connected end to end with plates attached to a central upright flange portions formed on each track section. Sealing tubular fittings are slidably received in each end of the rubular portions adjacent sections held by the plates to allow air pressure to be distributed. Air pressure fittings are inserted in drilled holes along the track sections, held in by brackets. The trolleys have rollers engaged with opposite upper sides of the tubular portions, the trolley rollers separable to allow removal from the track sections.

8 Claims, 3 Drawing Sheets

OVERHEAD TROLLEY— RAIL SYSTEM FOR CONVEYORS

BACKGROUND OF THE INVENTION

This invention concerns overhead rail systems for conveyor trolleys. A low cost construction previously used has consisted of steel pipe sections welded together, on which run trolleys having sets of angled wheels in engagement with the pipe sides. The steel piping is also sometimes employed as a distribution conduit for compressed air, with welded on fittings provided for connection to air operated tools, hoists, etc.

The use of welded joints makes fabrication difficult as welding must be conducted in the overhead location, and each weld ground smooth to insure that the trolleys will run freely over the joint. Because of the welded construction, it is difficult to reconfigure the systems. Threaded connections for the joints and or operated devices are impractical since if the threads are damaged, an entire rail section may need to be replaced.

The trolleys used also are difficult to remove, as they are captured by the tubing sides, such that they must be run off an end of the rail system, or completely disassembled to be removed. Corrosion of the steel piping is also a problem.

It is an object of the present invention to provide a tubular rail system for overhead conveyors which is easy to install, and which can be easily provided with additional air outlets.

SUMMARY OF THE INVENTION

The above object and others which will become apparent upon a reading of the following specification and claims are achieved by using a length of heavy walled aluminum tubing forming each track section, the tubing connected with a coupling having opposite ends push fit into adjacent tubing section end. The connected ends are held together with bolted splice plates attached to adjacent upright flange portions integrally formed with the tubing sections. Coupling seals may also be included to allow compressed air to be distributed within the connected tubing sections. Plug in air supply fittings are inserted in drilled holes in the tubing, held with a bolted angle plate attached to a rail flange.

The trolleys are constructed of two overlapping plates, each carrying one of the angled rollers, the plates able to be swiveled to separate the rollers when a locking bolt is removed, greatly facilitating the removal of a trolley at any point along the rail.

A section open at the bottom can also be used instead of the tubular section, for use as a conduit for wiring, a snap fit cover able to be installed to completely enclose the wiring.

DESCRIPTION OF THE DRAWING FIGURES

DETAILED DESCRIPTION

Figure 1:
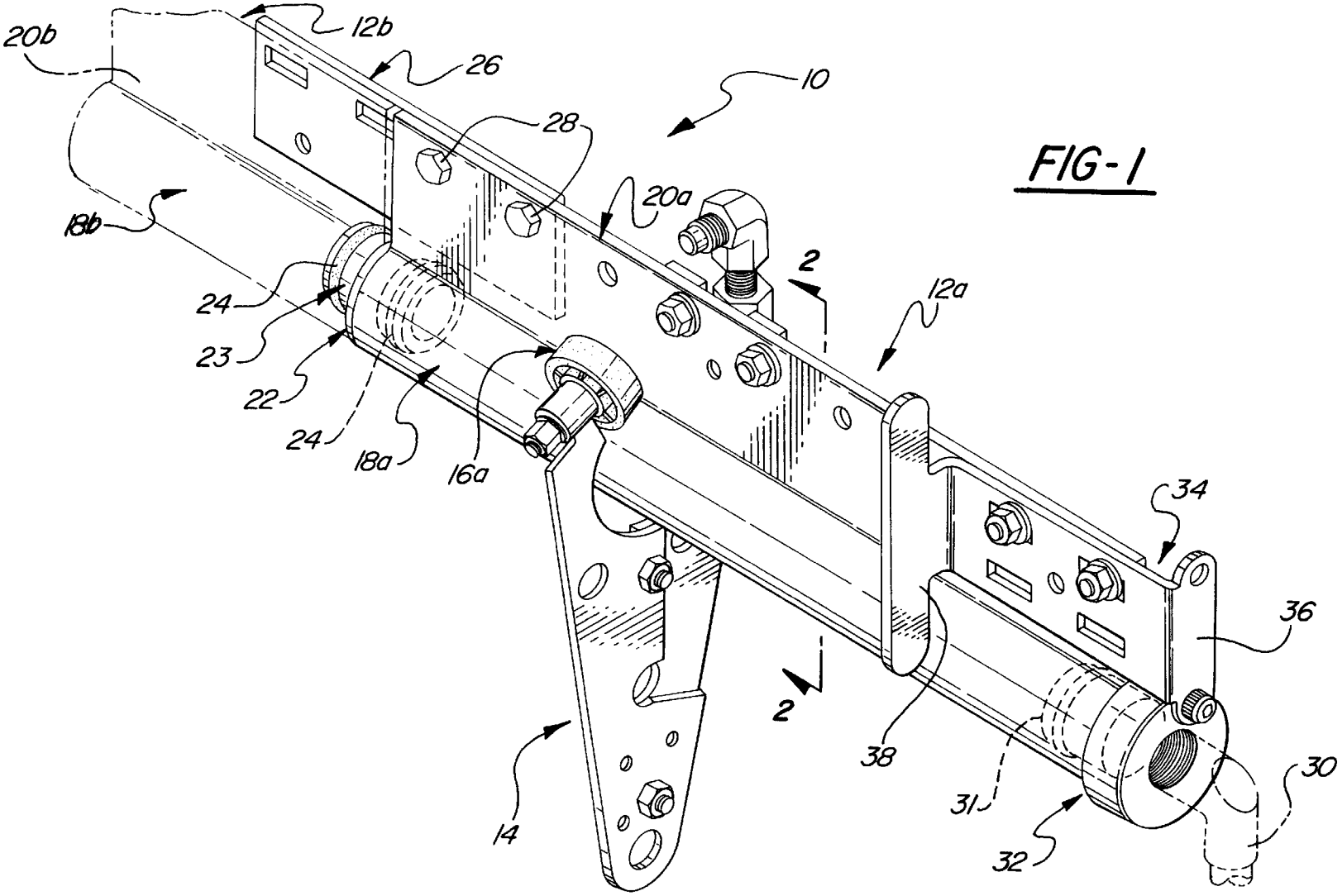
FIG. 1 is a perspective view of a track end section and trolley according to the present invention, with an adjacent track section shown in phantom.

Referring to FIG. 1 on overhead rail system 10 includes end to end connected rail sections 12A, 12B supported by a system of overhead hangers (not shown) of conventional design.

A trolley 14 is shown, which has a pair of inclined rollers 16A, 16B straddling the upper surface of a tubular portion 18A, 18B of each rail section 12A, 12B.

The adjacent rail sections 12A, 12B preferably formed from an aluminum extrusion each include the tubular portion 18 and an upright central flange portion 20, preferably formed from an aluminum extrusion.

Adjacent ends are aligned by a coupling fitting 22 having oppositely projecting plugs 23 joined by a flange 21. Respective Plugs 23 fit into the interior of the adjacent sections 12A and 12B. Sealing O-rings 24 are installed when the interior is to be pressurized with air.

Figure 4:
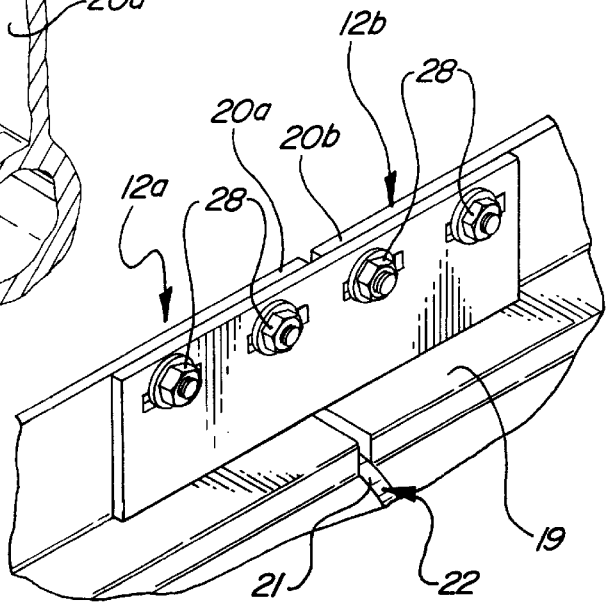
FIG. 4 is an enlarged fragmentary perspective view of a splicing connector plate installation joining adjacent rail sections.

A splicing connector plate 26 overlaps adjacent aligned flanges 20A, 20B, secured with nut and bolt sets 28 (FIG. 4) to hold the sections 12A, 12B together securely in end to end abutment with the flange 21, capturing the coupling fitting 22 as shown in FIG. 4.

The free end of section 12A may have an air supply fitting 30 installed, by being threaded into a threaded plug fitting 32 having a reduced diameter end 31 inserted into the tubular section 18A.

A combination stop retention bracket 34 is bolted to the control flange 20, and includes a retention tab 36 overlying the endface of the fitting 32 with a capscrew 33 securing the fitting 32 in position.

Figure 2:
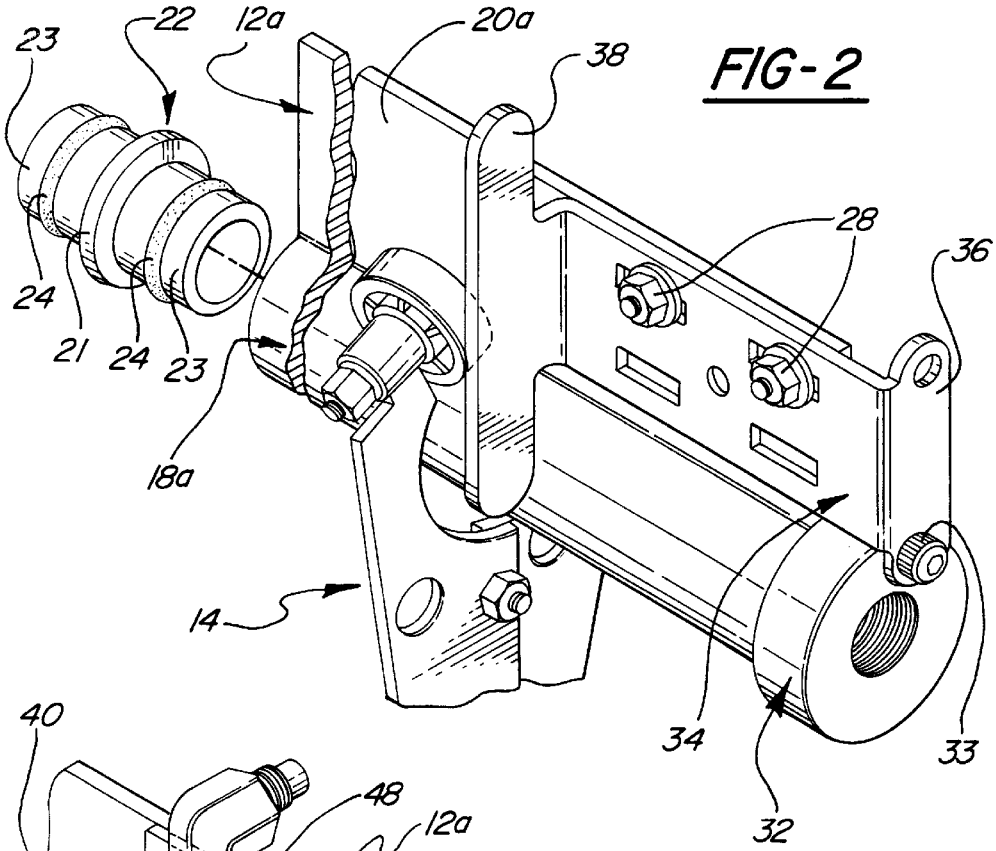
FIG. 2 is an enlarged fragmentary view of the end portion of the track end section shown in FIG. 1.
Figure 3:
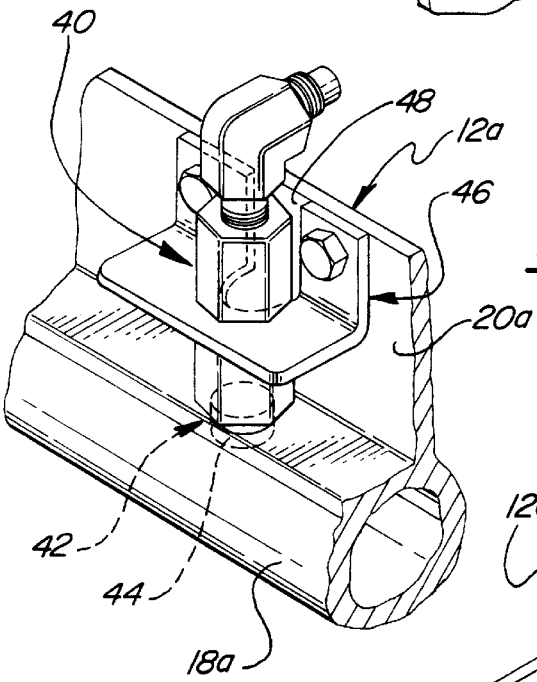
FIG. 3 is an enlarged fragmentary perspective view of a track section with a air supply fitting installed.

A trolley stop tab 38 extends down over the tubular section 18A preventing travel of the trolleys 14 past the tab 38 as shown in FIG. 2. The bracket 34 is reversible for ends terminating to the left, by end over end rotation thereof.

Air pressure fittings 40 can be installed, at any point along any of the track sections 12A, 12B having a plug end 42 pressed into a drilled hole in the tubular section 18A, 18B an O-ring seal 44 installed thereon to prevent the escape of air.

A holder bracket 46 is bolted to the central flange 20 to secure the fitting 40 in position. The holder bracket 46 has a forked shape created by a cutout 48 received over a groove (not shown) in the body of the fitting 40 to positively restrain the same.

Since no threaded connection is required in the tubing sections, additional fittings can be installed at any location by simply drilling the necessary hole at the desired locations.

The track sections 12A, 12B are formed with a flat 19 (FIGS. 4 and 5) to assist in drilling holes and in installing the various fittings, brackets, and plates by providing a rest surface supporting these parts as they are in the process of being installed.

Figure 5:
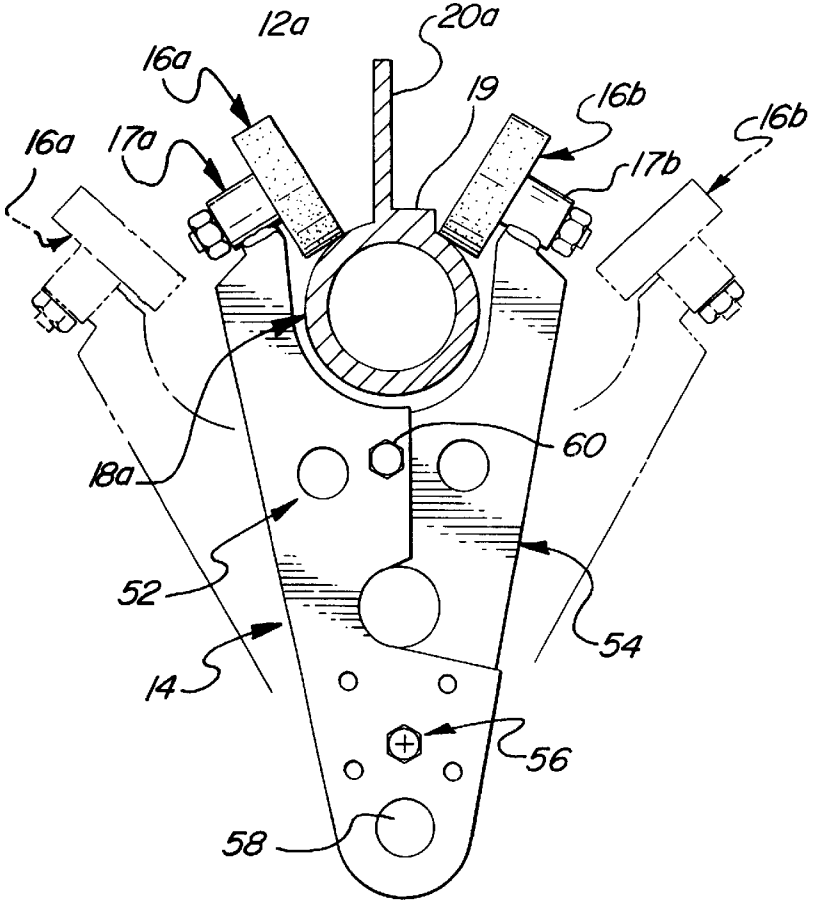
FIG. 5 is a front view of a trolley on a track section shown in section, with the separating releasing movement shown in phantom.

FIG. 5 shows further details of the trolley 14. The inclined rollers 16A and 16B are mounted on respective plates 52, 54 overlying each other, pivoted together with a pivot bolt 56. Aligned holes 58 are provided at lower ends to engage hangers supporting a part to be conveyed (not shown). The rollers 16A, 16B have axles supported in tubes 17A, 17B welded to a respective plate 52, 54.

A locking bolt 60 spaced above the pivot bolt 56 prevents the plates 52, 54 from pivoting apart, holding the rollers 16A, 16B straddling the tubular portion 18A.

Upon removing the locking bolt 60, the plates 52, 54 may be pivoted about the axis of the pivot bolt 56, which extends parallel to the direction in which the track extends to swing the rollers 16A 16B apart away from the track as shown in phantom, allowing removal of the trolley 14 from the track.

Figure 6:
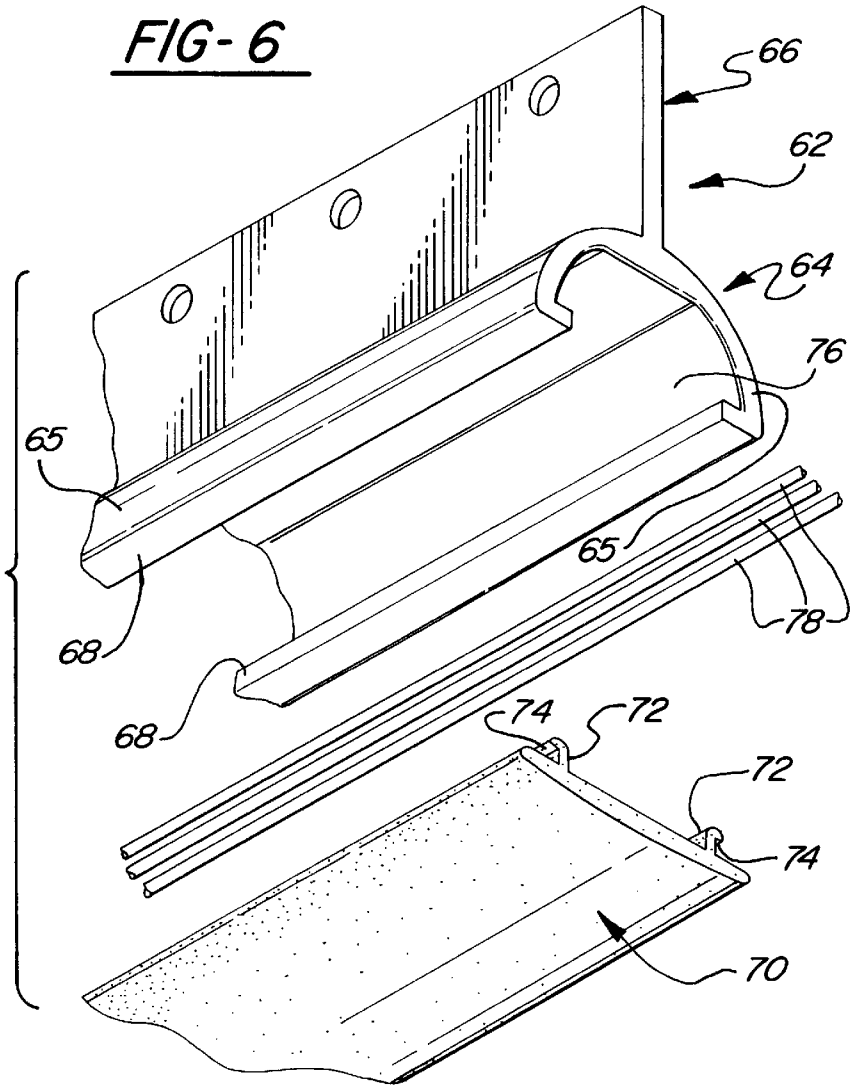
FIG. 6 is an exploded fragmentary perspective view from the bottom of one end of an alternate form of the track section and wiring and a cover therefor.

FIG. 6 shows an alternate construction in which an alternate form of the track section 62 is provided. This includes an arched portion 64, open at the bottom, with a central upstanding flange 66 projecting up from the top of the arched portion 64.

The arched position 64 is formed by downwardly projecting side walls 65 having spaced apart opposing lip edges 68 comprise shelf features able to capture a plastic cover strip 70, molded with lengthwise rib features 72 formed with outturned edges 74 positioned to snap over shelf the features 68.

Wiring 78 can be routed through the interior cavity 76 attached to flanges 66 as described above.

The adjacent sections 62 are connected with splicing plates similar to those used with the above described embodiment.

What is claimed is:

1. An over head trolley rail system comprising:

a series of track sections, each track section having a tubular portion and an upright central flange portion, said tubular portion formed with upper surfaces, one upper surface disposed on a respective side of said central flange portion;

connecting plates attached to said central flange portion of adjacent track sections to hold each tubular portion in end-to-end alignment with a tubular portion of a next adjacent track section;

said track sections having adjacent ends connected together by a coupling fitting having a pair of opposite plug ends each received in a respective adjacent track end tubular portion, said coupling fitting having a radial flange which each adjacent track end abuts; and, a trolley having a pair of spaced rollers each resting on one of said upper surfaces of said tubular portion of said track sections portion of said track sections.

2. The system according to claim 1 wherein each of said pair of plug ends have a seal sealing to an inside surface of said tubular portion in which a respective one of said pair of said plug ends is received.

3. The system according to claim 1 further including an overhead trolley rail system comprising:

a series of track sections, each track section having a tubular portion and an upright central flange portion, said tubular portion formed with upper surfaces, one upper surface disposed on a respective side of said central flange portion;

at least one air pressure utilizing device connection comprising a hole drilled into said tubular portion of one of said track sections and an air fitting slidably and sealingly received in said hole, and a retainer bracket attached to said flange portion engaging said fitting to hold the same inserted in said hole.

4. The system according to claim 1 wherein said track sections are formed of aluminum.

5. An overhead trolley rail system comprising:

a series of track sections, each track section having a tubular portion and an upright central flange portion, said tubular portion formed with upper surfaces, one upper surface disposed on a respective side of said central flange portion;

an air pressure fitting slideably sealingly fit into said tubular portion of one of said track sections, and a retainer plate fastened to said flange portion of said one of said track sections holding said air pressure fitting in said tubular portion.

6. The system according to claim 4 wherein said retainer plate has a stop tab portion positioned to engage said trolley at a point spaced ahead of where said trolley would reach said air pressure fitting.

7. An overhead trolley rail system comprising:

a series of track sections, each track section having a tubular portion and an upright central flange portion, said tubular portion formed with upper surfaces, one upper surface disposed on a respective side of said central flange portion;

said trolley comprising a pair of plates mounted together for relative pivoting motion about an axis parallel to the direction in which said track sections extend, each plate mounting a respective roller oriented to rollingly engage a respective upper surface, said rollers swung towards and away from each other and said track section upper surfaces by said pivoting motion; and, a removable fastener holding said plates at a particular point in said pivoting motion wherein said rollers positioned so as to rollingly engage said upper surfaces of said tubular portion of each of said track sections, removal of said fastener allowing swinging apart of said plates to clear said rollers from said tubular upper surfaces so as to allow removal of said trolley from said track sections.

8. An overhead trolley rail system comprising:

a series of track sections, each track section having a tubular portion and an upright central flange portion, said tubular portion formed with upper surfaces, one upper surface disposed on a respective side of said central flange portion;

each track section tubular portion having a lengthwise open bottomed cavity defined by a pair of downwardly projecting sides forming a part of said tubular portion, and further including a removable cover interfit to a bottom edge of said sides to form a closed cavity able to receive wiring routed within said cavity.

* * * * *

UNITED STATES PATENT AND TRADEMARK OFFICE

CERTIFICATE OF CORRECTION

PATENT NO. : 6,138,574
DATED : October 31, 2000
INVENTOR(S) : James Zaguroli, Jr.

It is certified that error appears in the above-identified patent and that said Letters Patent is hereby corrected as shown below:

Column 3,
Line 15, delete "shelf".
Line 15, after "snap over the" insert -- shelf --.
Line 17, delete "the" insert therefor -- an --.
Line 18, delete "attached to" insert therefor -- defined between the side walls, the wiring 78 thereby supported by the central --.
Line 32, delete "a" first occurrence, insert therefor -- the --.
Line 36, after "ends each" insert -- of plug ends --.
Delete lines 49-53.

Signed and Sealed this

First Day of October, 2002

*Attest:*

*Attesting Officer*

JAMES E. ROGAN
*Director of the United States Patent and Trademark Office*